US007409945B2

(12) United States Patent
Remele et al.

(10) Patent No.: US 7,409,945 B2
(45) Date of Patent: Aug. 12, 2008

(54) ARRANGEMENT FOR CONTROLLING AN INTERNAL COMBUSTION ENGINE

(75) Inventors: Jörg Remele, Hagnau (DE); Uwe Rödl, Friedrichshafen (DE); Andreas Schneider, Friedrichshafen (DE); Albrecht Debelak, Friedrichshafen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/821,546

(22) Filed: Jun. 22, 2007

(65) Prior Publication Data

US 2008/0011275 A1 Jan. 17, 2008

(30) Foreign Application Priority Data

Jun. 24, 2006 (DE) ..... 10 2006 029 083

(51) Int. Cl.
*F02M 51/00* (2006.01)
*F02M 51/04* (2006.01)

(52) U.S. Cl. ..... 123/474; 123/486

(58) Field of Classification Search ..... 123/472, 123/478–480, 486, 488, 490, 494
See application file for complete search history.

(56) References Cited

U.S. PATENT DOCUMENTS 5,575,264 A * 11/1996 Barron ..... 123/486
6,109,245 A * 8/2000 Egger et al. ..... 123/490
6,691,677 B2 2/2004 Eckerle et al.
6,766,788 B2 * 7/2004 Xu ..... 123/490
2004/0172188 A1 * 9/2004 Bowling et al. ..... 701/102
2008/0000453 A1 * 1/2008 Remele et al. ..... 123/472

FOREIGN PATENT DOCUMENTS

| | | |
|---|---|---|
| DE | 100 263 595 | 2/2002 |
| DE | 102 29 414 | 1/2004 |
| JP | 58 206872 | 12/1983 |
| WO | WO 97/23717 | 7/1997 |
| WO | WO 01/24320 | 4/2001 |

* cited by examiner

*Primary Examiner*—Mahmoud Gimie
(74) *Attorney, Agent, or Firm*—Klaus J. Bach

(57) ABSTRACT

In an arrangement for controlling an internal combustion engine, comprising an electronic engine control unit, an injector with an injection needle for controlling the injecting of fuel into a combustion chamber of the engine and a connecting line extending between the electronic engine control unit and the injector for the transmission if signals therebetween, an intelligent electronic component is integrated into the injector including an electronic memory unit, a computation unit, an energy storage device forming an energy supply for the electronic component and also a measuring unit for opto-electronically detecting the movement of the fuel injector needle.

4 Claims, 1 Drawing Sheet

ARRANGEMENT FOR CONTROLLING AN INTERNAL COMBUSTION ENGINE

BACKGROUND OF THE INVENTION

The invention resides in an arrangement for controlling an internal combustion engine with an electronic engine control unit, an injector for injecting fuel into the combustion chambers of the internal combustion engine, communication lines for the transmission of signals between the electronic engine control unit and the injectors and an intelligent electronic component which forms a construction unit with each injector.

In an internal combustion engine, the fuel injection begin and the fuel injection end are important for the quality of the combustion and the composition of the exhaust gas of the engine. In order to maintain the legal emission limits, these two characteristic values are generally controlled by an electronic engine control unit. In practice, an internal combustion engine with common rail fuel injection faces the problem that there is a time delay between the start of the energization of the injector, the needle lift of the injector and the actual injection begin. The same applies for the injection end.

For avoiding this problem, the particular properties of an injector may be recorded in a storage device which is arranged at the injector. During the operation, these parameters are then read by the electronic control unit into the control unit and the desired control values are adapted to the particular injector. WO 97/23717A shows such a system.

The system can be further improved by detecting the injection needle position inductively by changing the PWM (Pulse Width Modulator) signal via a displacement gauge or an opto-electronic procedure. An opto-electronic solution is known from JP 58 206872. It includes a light sender, a light conductor and a receiver with a comparator. By way of the comparator, a change in the light intensity is evaluated. In this solution, the sender, the receiver and the comparator are arranged outside the injector. In addition to the additional expenditures for the cables, the penetrations of the light conductors through the injector housing are critical. Particularly in the high pressure area of the injector a faulty penetration may cause leakages and result in failure of the injector.

DE 102 29 414 A1 discloses an injector with an integrated optical needle stroke sensing arrangement. The stroke is determined by way of an optical sender-receiver unit, which detects and counts the number of light-dark changes. The accuracy of this arrangement is established via the number of the light-dark fields.

It is the object of the present invention to provide a reliable injector with an improved opto-electric position determination for the injector needle.

SUMMARY OF THE INVENTION

In an arrangement for controlling an internal combustion engine, comprising an electronic engine control unit, an injector with an injection needle for controlling the injecting of fuel into a combustion chamber of the engine and a connecting line extending between the electronic engine control unit and the injector for the transmission if signals therebetween, an intelligent electronic component is integrated into the injector including an electronic memory unit, a computation unit, an energy storage device forming an energy supply for the electronic component and also a measuring unit for opto-electronically detecting the movement of the fuel injector needle.

The measuring unit comprises a light sender, that is, at least one light conductor, a light receiver for determining the light modulation and a comparator.

During the injection pauses the energy storage device supplies the energy for the electronic unit. This permits a bi-directional communication of the electronic engine control unit with the injector and vice versa also in the injection pauses. Energy is transmitted from the electronic engine control unit to the energy storage device during fuel injection via the existing connecting lines while also the energy storage device is charged. Generally, the connecting lines are two-conductor lines (twisted pair). In addition, the integrated computation unit and the electronic storage unit permit a comparison of a momentary light intensity with a light intensity reference value, whereby the injector detects and compensates for, any changes on its own.

With the integration of the complete measuring and control unit into the injector, the opto-electronic evaluation of the injector needle position is EMV resistant. In addition, the injector needle geometry does not need to be changed nor need the service intervals for the injector be changed. Since no light-dark fields or similar are necessary for the determination of the injector needle position the resolution of the information is improved.

Overall, with the arrangement according to the invention the degree of integration is increased resulting in an improved operability and, at the same time, a greater reliability of the fuel injection control arrangement.

The invention will be described below on the basis of a particular embodiment with reference to the accompanying drawings.

DESCRIPTION OF PARTICULAR EMBODIMENTS

Figure 1:
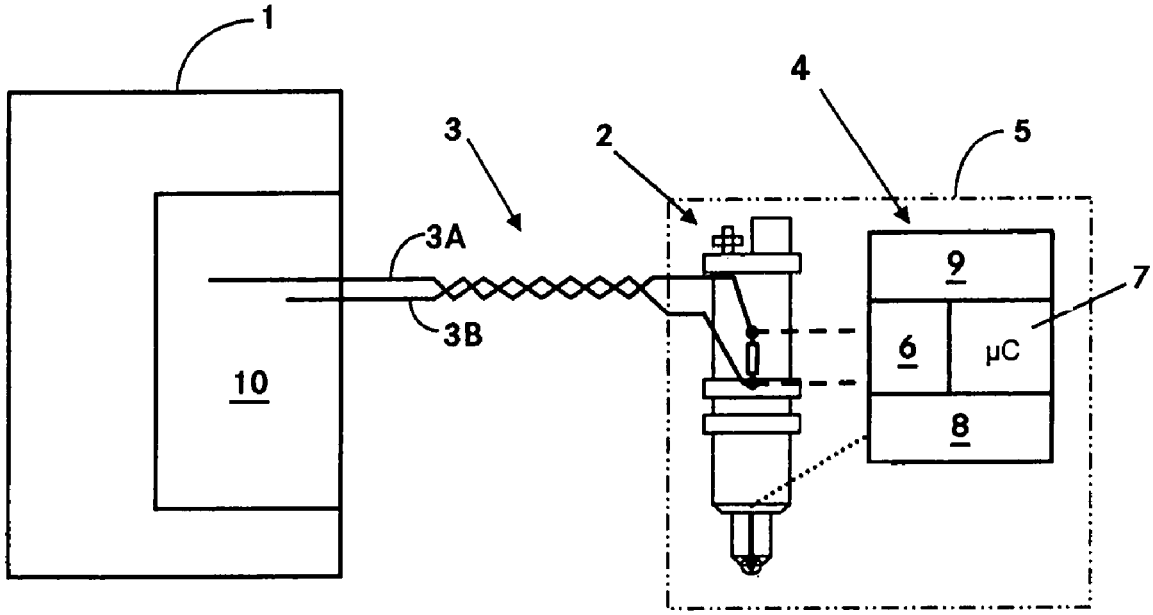
FIG. 1 shows the arrangement according to the invention with a two-wire communication line between the engine control unit and the injector.
Figure 2:
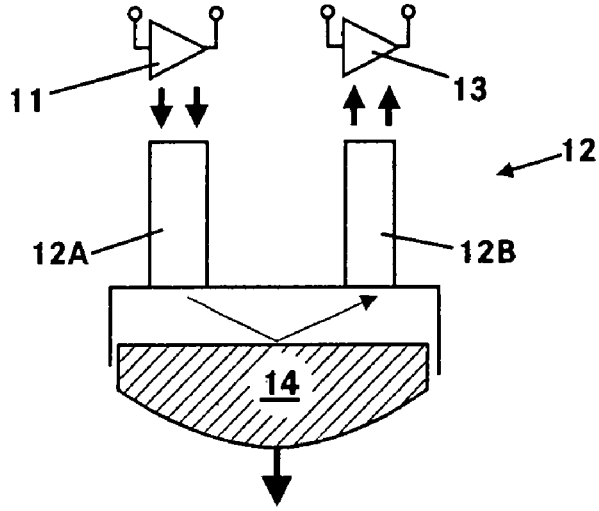
FIG. 2 shows schematically the measuring principle.

The invention is described based at the same time, on FIGS. 1 and 2. The arrangement comprises the following building units: An electronic engine control unit 1, connecting lines 3, an injector 2 and an intelligent electronic component 4 which forms, together with the injector 2, a common construction unit 5. The connecting lines 3 are formed by a twisted conductor pair including wire conductors 3A and 3B. The injector 2 may be an inductive injector or a piezo injector. The electronic component 4 comprises an electronic storage unit 6 for storing data, a computation unit 7 and a measuring unit 8. The latter provides for an optoelectronic sensing of the injector needle position via a sender 11, at least one light conductor 12, a receiver 13 and a comparator which is not shown—see in this respect FIG. 2.

The arrangement operates as follows:

Via the communication line 3, the injector 2 is activated by the engine control unit 1 (injection begin) or deactivated (injection end). After activation of the injector 2, the injection needle 14 begins to move downwardly for example as shown in FIG. 2. The needle position change causes a change in the reflection at the backside of the injector needle 14 of the light beam emitted by the sender 11. The change in the reflection causes a modulation of the light which is detected by the receiver 13, compared via the comparator with a reference value and evaluated. The comparator includes an adjustable comparator threshold. The movement begin, the stop point of the needle and, as a result, the opening duration of the needle valve can be accurately determined in this way.

Concurrently with the activation of the injector 2, energy is transferred from a power stage 10 of the electronic engine control unit 1 via the connecting lines 3 to the energy storage device 9. The energy storage device 9 is charged during the fuel injection while energy is supplied to the injector 2. Upon deactivation of the injector 9, the energy transfer is also terminated. During the injection pause, the electronic component 4 is supplied with energy from the energy storage device 9. In this way, a bidirectional communication can be maintained during the injection pause. For example, the electronic engine control unit 1 can read data out of the storage unit 6 and, if necessary, update the data stored in the storage unit 6 and it can cause the measuring unit 8 to perform an additional measurement.

The arrangement according to the invention as described can be modified in that, for the light communication, not two light conductors 12A and 12B but only one light conductor is used. Also, instead of the total or stray light reflection at the backside of the injector needle, the shadow image of the injector needle can be evaluated. For this procedure, the light conductors are oriented normal to the direction of movement of the injector needle. The connecting lines 3 can be supplemented by a third line (ground), so that the activation of the injector 2 and the energy transmission can be established independently. Then the electronic component 4 can be continuously applied with energy from the engine control unit.

The arrangement according to the invention as described above has the following advantages:

the opto-electronic injector needle position detection is EMV resistant the injector needle geometry remains unchanged the normal service intervals for the injectors can be maintained the lower components of the injectors which are subject to wear can be can be replaced in a simple manner.

What is claimed is:

1. An arrangement for controlling an internal combustion engine comprising an electronic engine control unit (1), at least one fuel injector (2) with an injector needle (14) for controlling the injection of fuel into a combustion chamber of the internal combustion engine, a connecting line (3) extending between the electronic engine control unit (1) and the injector (2) for the transmission of signals therebetween, and an intelligent electronic component (4) included in the injector (2) so as to form, together therewith, a structural unit (5), the electronic component (4) comprising an electronic memory unit (6) for storing data, a computation unit (7), an energy storage device (9) for storing electric energy and providing an energy supply for the electronic component (4) and also a measuring unit (8) for opto-electronically detecting the movement of the injector needle (14).

2. The arrangement according to claim 1, wherein the measuring unit (8) comprises a light sender (11), at least one light conductor (12) and a light receiver (13) for detecting any light modulation caused by the movement of the injector needle (14).

3. The arrangement according to claim 2, wherein the measuring unit (8) includes a comparator with an adjustable comparator threshold for evaluating the light modulation.

4. The arrangement according to claim 1, wherein the measuring unit (8) is deactivated during injection pauses.

* * * * *